US007765830B2

(12) United States Patent
Zhang

(10) Patent No.: US 7,765,830 B2
(45) Date of Patent: Aug. 3, 2010

(54) AUTOMATIC DISCHARGE DEVICE FOR LITHIUM BROMIDE ABSORPTION CHILLERS AND METHODS OF USING THE SAME

(76) Inventor: Yue Zhang, Yuanda Road, Yuanda, Changsha (CN) 410138

( * ) Notice: Subject to any disclaimer, the term of this patent is extended or adjusted under 35 U.S.C. 154(b) by 27 days.

(21) Appl. No.: 12/103,827

(22) Filed: Apr. 16, 2008

(65) Prior Publication Data

US 2008/0190133 A1 Aug. 14, 2008

Related U.S. Application Data

(63) Continuation of application No. PCT/CN2005/001698, filed on Oct. 17, 2005.

(51) Int. Cl.
*F25B 43/04* (2006.01)

(52) U.S. Cl. ..... 62/475; 62/483

(58) Field of Classification Search ..... 62/474, 62/475, 478, 483, 489, 467, 107, 487, 141, 62/144

See application file for complete search history.

(56) References Cited

U.S. PATENT DOCUMENTS 4,290,273 A * 9/1981 Meckler ..... 62/148
4,472,947 A * 9/1984 Saito et al. ..... 62/141
5,070,703 A * 12/1991 Wilkinson ..... 62/94
5,203,161 A * 4/1993 Lehto ..... 60/39.53
5,398,543 A * 3/1995 Fukushima et al. ..... 73/40.7
5,730,356 A * 3/1998 Mongan ..... 237/19
5,819,546 A * 10/1998 Uchida ..... 62/141
6,550,272 B2 * 4/2003 Nakajima et al. ..... 62/476
6,606,881 B1 * 8/2003 Justin ..... 62/475
6,742,347 B1 * 6/2004 Kolk et al. ..... 62/148
6,877,338 B2 * 4/2005 Gupte ..... 62/497
2002/0053214 A1 * 5/2002 Melendez-Gonzalez et al. ..... 62/235.1

* cited by examiner

*Primary Examiner*—Mohammad M Ali
(74) *Attorney, Agent, or Firm*—Matthias Scholl P.C.; Matthias Scholl

(57) ABSTRACT

The invention teaches an automatic discharge device for a lithium bromide absorption chiller unit, comprising an automatic pump apparatus, a pump chamber, a gas-liquid separation chamber, and a gas storage chamber. A valve F1 is disposed at the outlet line of the liquid pump. A valve F2 and a gas discharge and liquid feed line disposed between the liquid pump and the valve F1 are connected to the gas storage chamber. A valve F3 is set on the gas duct and liquid return line between the gas storage chamber and the gas-liquid separation chamber. A liquid choke self-closing discharge rubber ball valve, a one-way spring discharge valve, and additionally, an electromagnetic valve or a motorized valve are set on top of the gas storage chamber. The invention simplifies effectively the chiller construction and increases operational reliability.

5 Claims, 1 Drawing Sheet

AUTOMATIC DISCHARGE DEVICE FOR LITHIUM BROMIDE ABSORPTION CHILLERS AND METHODS OF USING THE SAME

CROSS-REFERENCE TO RELATED APPLICATION

This application is a continuation of International Patent Application No. PCT/CN2005/001698 filed on Oct. 17, 2005, designating the United States, now pending, the contents of which are incorporated herein by reference.

BACKGROUND OF THE INVENTION

1. Field of the Invention

The invention relates to an automatic discharge device for lithium bromide absorption chillers and methods of using the same, and more specifically, to an automatic discharge device for lithium bromide absorption chillers which does not employ a vacuum pump.

2. Description of the Related Art

Lithium bromide-based absorption chillers are capable of providing large-tonnage central air conditioning. Water is flash boiled under vacuum at low temperatures. Vacuum is provided by vacuum pumps. The boiling action cools evaporator or chilled water coils. As the flashed water vapor accumulates inside the chiller, vacuum is lost. Lithium bromide is added to absorb the water vapor, maintaining the vacuum condition.

Diluted lithium bromide cannot continue to absorb water and must be reconstituted to perpetuate the cycle. Reconstituted lithium bromide is returned to absorb water once more, and the boiled-off water is returned to be flashed again. The cycle is then complete.

Vacuum pumps need much maintenance and often brake down. Accordingly, much is to be gained by providing automatic discharge devices for lithium bromide absorption chillers that do not use vacuum pumps.

SUMMARY OF THE INVENTION

Therefore, to overcome the drawbacks described above, it is an objective of the invention to provide an automatic discharge device for lithium bromide absorption chillers that does not use a vacuum pump, yet is capable to discharge automatically vapor built up in the chiller into the atmosphere, simplifying effectively chiller construction, and increasing operation reliability.

In order to realize the above objective, there is provided an automatic discharge device without vacuum pump for a lithium bromide absorption chiller, comprising: an automatic pump apparatus, a pump chamber, a gas-liquid separation chamber, and a gas storage chamber. The automatic pump apparatus transfers a non-condensable gas into the pump chamber via a suction line. The pump chamber then transfers the non-condensable gas into the gas-liquid separation chamber via a pump line. The gas-liquid separation chamber is connected to the gas storage chamber via an gas duct and liquid return line. The liquid is returned to the chiller via a pipeline.

A valve F1 is disposed at the outlet line of the liquid pump of the lithium bromide absorption chiller. A gas discharge and liquid feed line disposed between the liquid pump and the valve F1 is connected to the gas storage chamber. A valve F2 is set on the discharge and liquid feed line. A valve F3 is set on the gas duct and liquid return line between the gas storage chamber and the gas-liquid separation chamber. A valve unit is set on top of the gas storage chamber.

The valve unit set on top of the gas storage chamber comprises a liquid choke self-closing discharge rubber ball valve, a one-way spring discharge valve, and additionally an electromagnetic valve or a motorized valve. The valve body of the liquid choke self-closing discharge rubber ball valve comprises an upper cone, a lower cone, and a rubber ball suspended freely between the upper cone and the lower cone. The density of the rubber ball is lower than that of the liquid.

Closing the valves F1 and F3 and opening the valve F2 starts the liquid pump forcing the liquid into the gas storage chamber. Then, the gas in the gas storage chamber is compressed. When the pressure reaches a certain threshold, the one-way spring discharge valve is lifted open, and the gas discharges automatically. After the gas is discharged, the rubber ball of the liquid choke self-closing discharge rubber ball valve ascents to hermetically seal with the upper cone to prevent discharge of the liquid.

If there is gas entering through the liquid choke self-closing discharge rubber ball valve, the liquid is forced back to the gas storage chamber, the rubber ball descents to hermetically seal the lower cone to prevent the gas from entering into the gas storage chamber, and the discharge process is finished.

Closing the valve F2 and opening the valves F1 and F3 causes the liquid in the gas storage chamber to fall back due to gravity. This automatically generates vacuum in the gas storage chamber and causes the automatic pump apparatus to start pumping again.

In certain embodiments of the invention, the flow direction of the liquid can be changed so that the automatic discharge of the lithium bromide absorption chiller unit is realized without the need of vacuum pump or a palladium tube. Therefore, the chiller construction is simplified and the operation reliability is increased. The decrease of refrigerating capacity and the corrosion caused by the chiller leakage are also avoided.

In addition, operating problems such as oil emulsification in the vacuum pump, the decrease of the pump speed, the corrosion and breakdown of the pump are avoided. The invention simplifies effectively the chiller construction, increases operation reliability, and enhances the technical performance of the chiller unit.

DETAILED DESCRIPTION OF THE INVENTION

Figure 1:
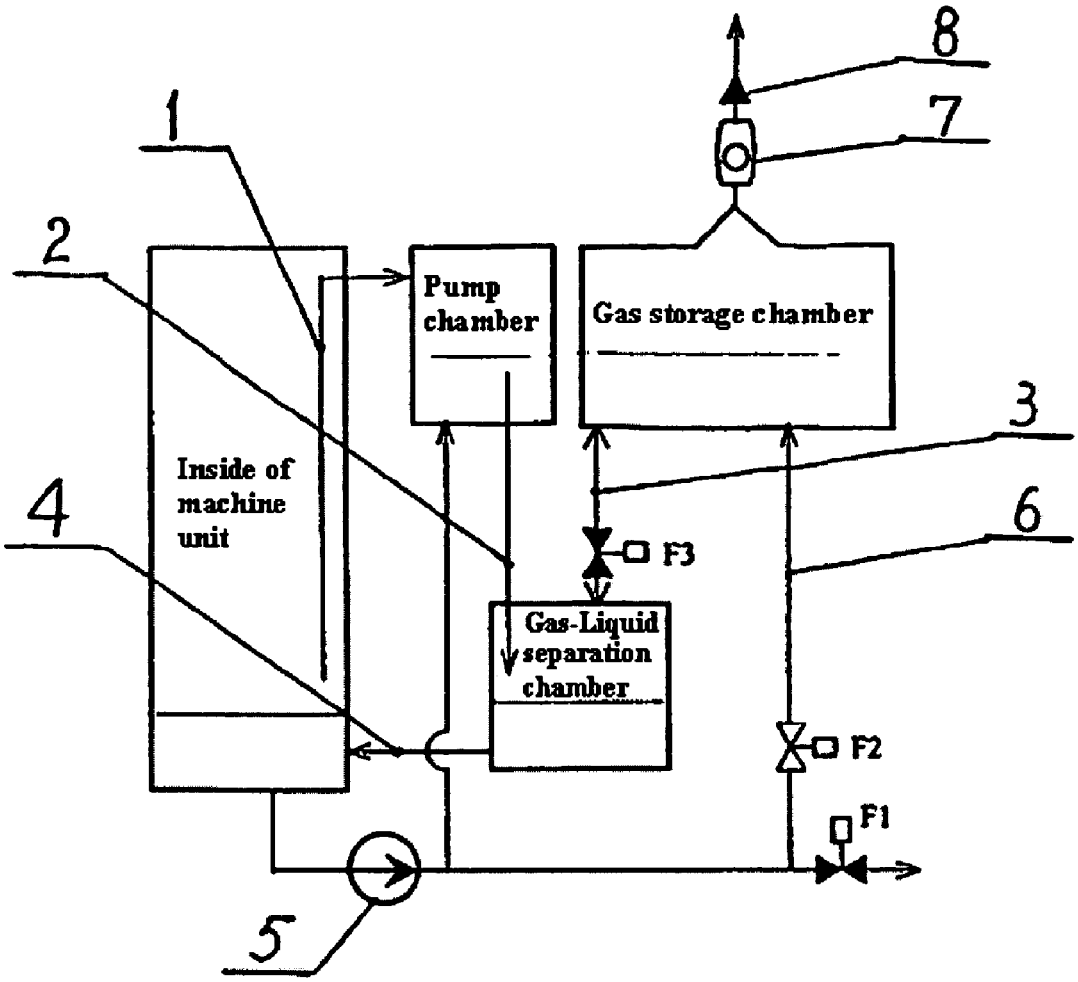
FIG. 1 illustrates the structure of the automatic discharge device of the invention.

With reference to FIG. 1, the automatic discharge device for lithium bromide absorption chiller comprises an automatic pump apparatus, a pump chamber, a gas-liquid separation chamber, and a gas storage chamber. The automatic pump apparatus transfers a non-condensable gas from the chiller into the pump chamber via a suction line 1. The pump chamber then transfers the non-condensable gas by means of liquid flow into the gas-liquid separation chamber via a pump line 2. The gas-liquid separation chamber is connected to the gas storage chamber via the gas duct and liquid return line 3. The liquid is returned to the chiller via a pipeline 4.

Extra gas accumulated in the gas storage chamber needs to be discharged into the atmosphere. With reference to FIG. 1, valve F1 is disposed at the outlet line of the liquid pump 5 of the lithium bromide absorption chiller. A gas discharge and liquid feed line 6 disposed between the liquid pump 5 and the valve F1 is connected to the gas storage chamber. The valve F2 is set on the gas discharge and liquid feed line 6. The valve F3 is set on the gas duct and liquid return line 3 between the gas storage chamber and the gas-liquid separation chamber. A valve unit is set on top of the gas storage chamber. The valve unit comprises a liquid choke self-closing discharge rubber ball valve 7 and a one-way spring discharge valve 8, and additionally, an electromagnetic valve or a motorized valve.

Figure 2:
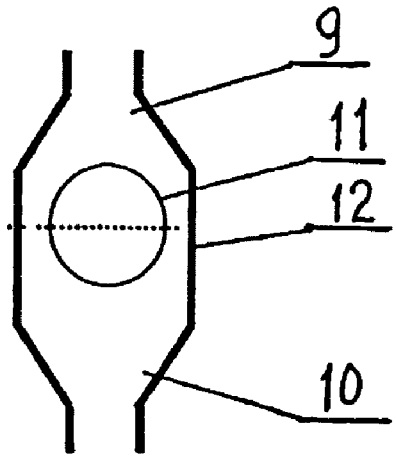
FIG. 2 illustrates the structure of the liquid choke self-closing discharge rubber ball valve.

With reference to FIG. 2, the valve body 12 of liquid choke self-closing discharge rubber ball valve 7 comprises an upper cone 9, a lower cone 10, and a rubber ball 11 suspended freely between the upper cone and the lower cone. The density of the rubber ball 11 is lower than that of the liquid. The one-way spring discharge valve 8 opens or closes according to the level of the spring pressure. When the pressure in the valve exceeds the spring pressure, the valve opens automatically; otherwise, the valve closes.

The automatic discharge process is as describe below. Closing the valves Fl and F3 and opening the valve F2 stars the liquid pump 5 to force the liquid into the gas storage chamber. The gas in the gas storage chamber is compressed. When the pressure exceeds a certain threshold, the one-way spring discharge valve 8 is lifted open, and the gas discharges automatically. After the gas is discharged, the rubber ball of the liquid choke self-closing discharge rubber ball valve ascents to hermetically seal with the upper cone 9 to prevent the overflow of the liquid. If there is gas entering through the liquid choke self-closing discharge rubber ball valve, the liquid is forced back to the gas storage chamber. The rubber ball then descents to hermetically seal with the lower cone 10 to prevent the gas entering into the gas storage chamber and the discharge process is finished.

Closing the valve F2, and opening the valves F1 and F3 causes the liquid in the gas storage chamber to fall back due to gravity. The gas storage chamber then acts as a vacuum chamber for facilitating the automatic pump apparatus to start pumping again.

This invention is not to be limited to the specific embodiments disclosed herein and modifications for various applications and other embodiments are intended to be included within the scope of the appended claims. While this invention has been described in connection with particular examples thereof, the true scope of the invention should not be so limited since other modifications will become apparent to the skilled practitioner upon a study of the drawings, specification, and following claims.

What is claimed is:

1. An automatic discharge device for a lithium bromide absorption chiller, comprising an automatic pump apparatus having a pump chamber; a gas-liquid separation chamber; a liquid pump; and a gas storage chamber;

wherein the pump chamber receives non-condensable gas from the chiller and transfers the non-condensable gas by means of liquid flow into the gas-liquid separation chamber;

the gas-liquid separation chamber receives the non-condensable gas from the pump chamber, receives liquid from the gas storage chamber via a liquid return line, separates gas from liquid, and returns the liquid back to the chiller;

the liquid pump pumps liquid from the chiller to the pump chamber and the gas storage chamber;

the gas storage chamber receives gas from the gas-liquid separation chamber via a gas duct and receives liquid from the chiller via a liquid feed line;

said gas-liquid separation chamber is connected to said gas storage chamber via the gas duct and the liquid return line, a first valve (F1) is disposed at an outlet line of the liquid pump, a gas discharge and liquid feed line disposed between the liquid pump and the valve Fl is connected to said gas storage chamber, a second valve (F2) is disposed on the discharge and liquid feed line, a third valve (F3) is disposed on the gas duct and the liquid return line between the gas storage chamber and the gas-liquid separation chamber, a valve unit for discharging gas from gas storage chamber when the pressure in the gas storage chamber reaches a certain threshold is set on top of the gas storage chamber;

closing the first valve and third valve and opening the second valve starts the liquid pump forcing the liquid into the gas storage chamber; and closing the second valve and opening the first valve and third valve F1 causes the liquid in the gas storage chamber to fall back due to gravity.

2. The device of claim 1, wherein said automatic pump apparatus transfers a non-condensable gas from the chiller to the pump chamber via a suction line;

said pump chamber transfers the non-condensable gas into the gas-liquid separation chamber via a pump line; and a liquid is returned to the chiller via a pipeline.

3. The device of claim 1, wherein the valve unit comprises a liquid choke self-closing discharge rubber ball valve, a one-way spring discharge valve, and an electromagnetic valve or a motorized valve;

the valve body of liquid choke self-closing discharge rubber ball valve comprises an upper cone, a lower cone, and a rubber ball suspended freely between the upper cone and the lower cone; and the density of the rubber ball is lower than that of the liquid.

4. A method of using the device of claim 1 comprising:

closing the first valve (F1) and the third valve (F3), opening the second valve (F2), starting the liquid pump to force the liquid into the gas storage chamber, compressing the gas in the gas storage chamber;

when the pressure exceeds a certain threshold allowing a one-way spring discharge valve lift to open and the gas to discharge automatically;

after the gas is discharged, allowing a rubber ball of the liquid choke self-closing discharge rubber ball valve to ascent and to hermetically seal the upper cone to prevent the overflow of the liquid;

when gas is entering through the liquid choke self-closing discharge rubber ball valve forcing the liquid back to the gas storage chamber, allowing the rubber ball to descend and to hermetically seal with lower cone to prevent the gas from entering into the gas storage chamber;

closing the second valve (F2), and opening the first valves (F1) and the third valve (F3), and allowing the liquid in the gas storage chamber to fall back under the force of gravity; and allowing vacuum to build in the gas storage chamber to facilitate the automatic pump apparatus to start pumping again.

5. A method of using the device of claim 1 comprising:

periodically closing the first valve (F1) and the third valve (F3), and opening the second valve (F2), and periodically closing the second valve (F2), and opening the first valve (F1) and the third valve (F3).

* * * * *